US010533788B2

(12) United States Patent
Gutkowski et al.

(10) Patent No.: US 10,533,788 B2
(45) Date of Patent: Jan. 14, 2020

(54) ICE SCOOP WITH FOCUSED DISPENSING REGION

(71) Applicants: BSH Home Appliances Corporation, Irvine, CA (US); BSH Hausgeräte GmbH, Munich (DE)

(72) Inventors: William Gutkowski, Costa Mesa, CA (US); Andy Mok, Stanton, CA (US); Benjamin Spradley, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 70 days.

(21) Appl. No.: 15/874,933

(22) Filed: Jan. 19, 2018

(65) Prior Publication Data

US 2019/0226740 A1 Jul. 25, 2019

(51) Int. Cl.
*F25C 5/04* (2006.01)
*A47F 13/08* (2006.01)

(52) U.S. Cl.
CPC ..... *F25C 5/043* (2013.01); *A47F 13/08* (2013.01); *F25C 2400/04* (2013.01)

(58) Field of Classification Search
CPC ..... F25C 5/043; A47F 13/08; A47J 43/288; A47G 21/04; A47G 21/045; B65H 3/32; G07D 9/02
USPC ..... 294/55, 176, 177, 178, 179, 180; D7/688, 691; D32/74; 15/257.1; D30/162
See application file for complete search history.

(56) References Cited

U.S. PATENT DOCUMENTS

| | | | | | |
|---|---|---|---|---|---|
| 2,511,560 | A | * | 6/1950 | Bechmann | A01C 15/02 239/652 |
| 2,563,223 | A | | 8/1951 | Dreher | |
| D190,383 | S | | 5/1961 | Hanson | |
| D191,466 | S | * | 10/1961 | Reichlein | 15/257.1 |
| D194,217 | S | * | 12/1962 | Bloch | D32/74 |
| D202,721 | S | * | 11/1965 | Wenzlaff | 15/257.1 |
| 3,278,969 | A | * | 10/1966 | Wenzlaff | A47L 13/52 15/257.7 |
| D272,552 | S | | 2/1984 | Clanton | |
| D308,151 | S | | 5/1990 | Roberts et al. | |
| D423,306 | S | | 4/2000 | Kari | |
| 7,118,145 | B1 | * | 10/2006 | Rosine | B25G 1/01 294/57 |
| 7,509,705 | B1 | * | 3/2009 | Morad | A47L 13/52 15/257.1 |
| D591,953 | S | | 5/2009 | Krus et al. | |
| D641,266 | S | | 7/2011 | Tamura et al. | |
| D678,007 | S | | 3/2013 | Suess et al. | |

(Continued)

*Primary Examiner* — Andrew D Stclair
(74) *Attorney, Agent, or Firm* — Michael E. Tschupp; Andre Pallapies; Brandon G. Braun

(57) ABSTRACT

A scoop includes a rear wall and a pair of spaced apart side walls; a gripping portion disposed on at least one of the rear wall or side walls; a floor portion connected to the rear wall and the pair of spaced apart side walls, the floor portion having a front edge portion; and a recessed portion formed in the floor portion adjacent to at least one of the spaced apart side walls and dipping below a level of the floor portion, the recessed portion being configured to guide a material contained in the scoop toward the front edge portion of the scoop while dispensing the material from the scoop.

15 Claims, 8 Drawing Sheets

(56) References Cited

U.S. PATENT DOCUMENTS

| | | | | |
|---|---|---|---|---|
| D756,246 | S | 5/2016 | Kent | |
| 9,538,823 | B2 * | 1/2017 | Hayes | A45D 19/00 |
| 2007/0089259 | A1 * | 4/2007 | Jones | A46B 15/00 15/257.2 |
| 2011/0285158 | A1 * | 11/2011 | Workman | A47F 13/08 294/178 |

* cited by examiner

ICE SCOOP WITH FOCUSED DISPENSING REGION

FIELD OF THE INVENTION

The present disclosure relates generally to a scoop for pouring or dispensing a material and, more particularly, to a scoop having a focused dispensing or guide region for scooping a material and then easily pouring or dispensing the material into a container which has a smaller opening.

For example, the scoop comprises an ice scoop having a recessed portion being configured to guide ice pieces contained in the ice scoop toward the front edge portion of the ice scoop while dispensing the ice pieces from the ice scoop into a container such as a glass, cup, sports bottle, water bottle, etc., which has a smaller or narrower opening.

BACKGROUND OF THE INVENTION

In general, scoops for scooping out and dispensing solid materials such as sugar, coffee, grain, seeds, candy, ice, and the like have upstanding walls at the rear and two sides while the front portion is open to allow solid material to be scooped up at the front edge and then held in the scoop by the walls until the solid material is poured or dispensed from the scoop by tipping the scoop forward such that the solid material pours or slides out of the front portion and into a container, etc.

SUMMARY OF THE INVENTION

However, when a user desires to pour or dispense solid material into a small opening, it is difficult to tip the scoop forward to empty the solid material without having the solid material pour out and miss the container and make a mess and waste solid material. It is particularly difficult to pour or dispense ice pieces from a standard scoop into a container having a smaller or narrower opening such as a glass, cup, sports bottle, water bottle, etc., because while some of the ice pieces may make it through the opening and into the bottle, for example, many of the ice pieces miss and end up on the floor or counter top.

An apparatus consistent with the present disclosure is directed to providing a scoop that can focus or guide a solid material, such as but not limited to ice pieces, into a container having a small opening to ensure that most if not all the ice pieces make it through the opening and into the container when ice pieces are poured or dispensed from the scoop.

According to one aspect, the present disclosure provides a scoop that includes a rear wall and a pair of spaced apart side walls; a gripping portion disposed on at least one of the rear wall or side walls; a floor portion connected to the rear wall and the pair of spaced apart side walls, the floor portion having a front edge portion; and a recessed portion formed in the floor portion adjacent to at least one of the spaced apart side walls and dipping below a level of the floor portion, the recessed portion being configured to guide a material contained in the scoop toward the front edge portion of the scoop while dispensing the material from the scoop.

According to another aspect, the scoop includes a dividing wall protruding from the floor portion at a location adjacent to the recessed portion so as to divide the recessed portion from a remainder of the floor portion.

According to another aspect, the scoop includes a plurality of ribs protruding from the floor portion.

According to another aspect, each of the plurality of ribs is shaped so as to gradually increase in height from the front edge portion of the scoop rearward toward the rear wall and then define a blunt surface facing the rear wall.

According to another aspect, the material comprises ice pieces and the plurality of ribs keeps the ice pieces from falling out of the scoop while the ice pieces are being dispensed from the scoop through the recessed portion.

According to another aspect, each of the plurality of ribs is generally triangular in shape when viewed from a side view.

According to another aspect, the rear wall and the pair of spaced apart side walls join the floor portion with a smooth curve.

According to another aspect, the recessed portion is formed with a smooth rounded curvature on its sides which gradually flatten out at a bottom of the recessed portion when viewed from a front view.

According to another aspect, the recessed portion is formed with a smooth rounded curvature on its sides and at a bottom of the recessed portion when viewed from a front view.

According to another aspect, the recessed portion is inclined downward so as to become gradually deeper in a direction toward the front edge portion of the scoop.

According to another aspect, the gripping portion comprises a handle disposed on the rear wall.

According to another aspect, the scoop is formed of at least one of acrylonitrile butadiene styrene (ABS), polypropylene resin, or stainless steel metal.

According to another aspect, the present disclosure provides an ice scoop comprising: a rear wall and a pair of spaced apart side walls; a gripping portion disposed on at least one of the rear wall or side walls; a floor portion connected to the rear wall and the pair of spaced apart side walls, the floor portion having a front edge portion; and means, formed in the floor portion adjacent to at least one of the spaced apart side walls, for guiding of ice pieces contained in the ice scoop toward the front edge portion of the ice scoop and into a container.

According to another aspect, ice scoop includes a plurality of ribs protruding from the floor portion.

According to another aspect, each of the plurality of ribs is shaped so as to gradually increase in height from the front edge portion of the ice scoop rearward toward the rear wall and then define a blunt surface facing the rear wall.

According to another aspect, the plurality of ribs keeps the ice pieces from falling out of the ice scoop while the ice pieces are being dispensed from the ice scoop through the means for guiding.

According to another aspect, each of the plurality of ribs is generally triangular in shape when viewed from a side view.

According to another aspect, the rear wall and the pair of spaced apart side walls join the floor portion with a smooth curve.

According to another aspect, the gripping portion comprises a handle disposed on the rear wall.

According to another aspect, the means for guiding comprises a recessed portion that is inclined downward so as to become gradually deeper in a direction toward the front edge portion of the ice scoop.

According to another aspect, the ice scoop is formed of at least one of acrylonitrile butadiene styrene (ABS), polypropylene resin, or stainless steel metal.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, rearward, upper, lower, upward, downward, and the like used herein are for orientation purposes with respect to the drawings when describing the exemplary embodiments and should not limit the present invention.

Figure 1:
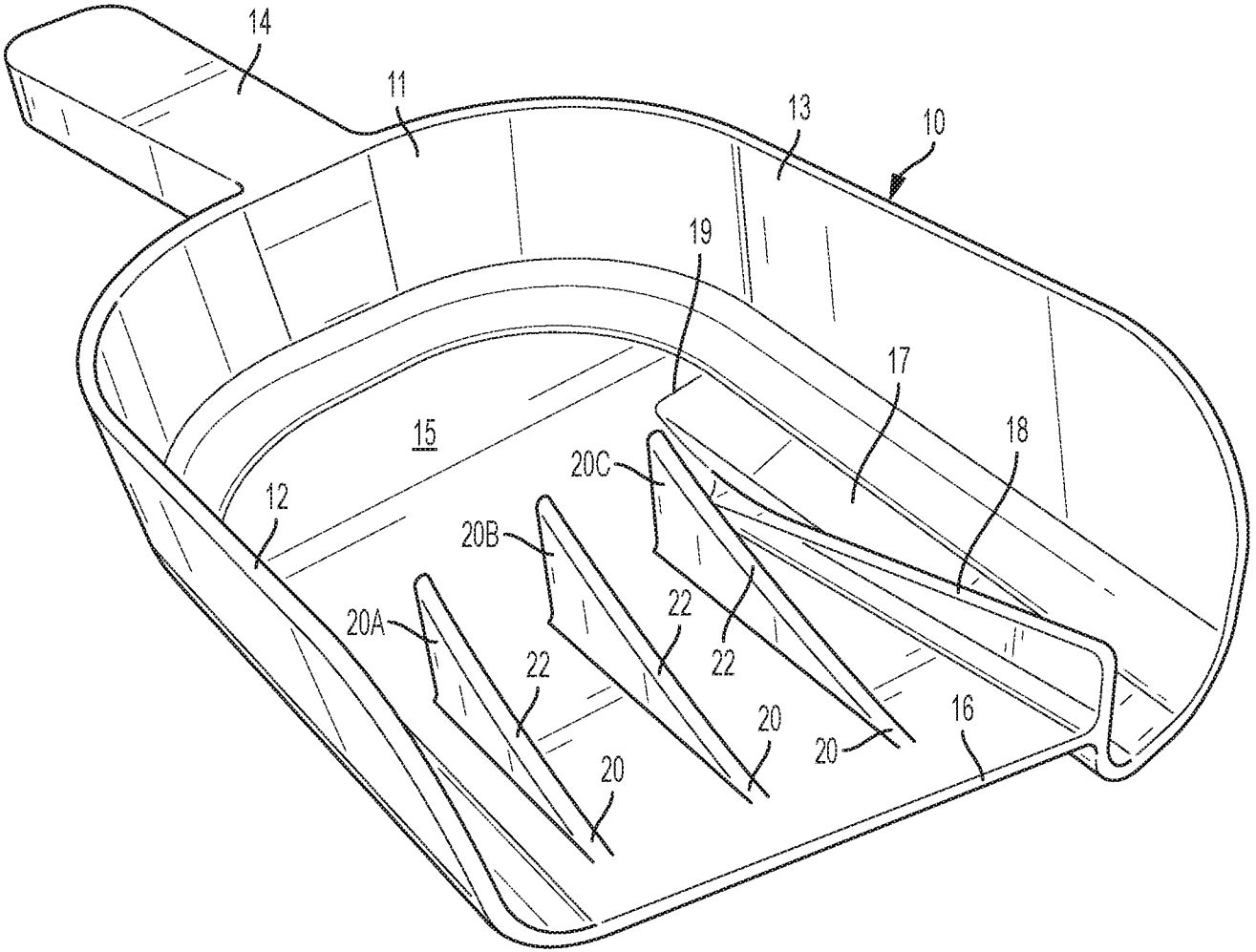
FIG. 1 illustrates a top, front, and left side perspective view of a scoop according to an exemplary embodiment consistent with the present disclosure.

FIG. 1 is a top, front, and left side perspective view of a scoop 10 according to an exemplary embodiment consistent with the present disclosure. The scoop 10 includes a rear wall 11 and a pair of spaced apart side walls 12 and 13. A gripping portion such as, but not limited to, a handle 14 is disposed on at least one of the rear wall 11 or side walls 12, 13. A floor portion 15 is connected to the rear wall 11 and the pair of spaced apart side walls 12, 13. Preferably, the rear wall 11 and the pair of spaced apart side walls 12, 13 join the floor portion 15 with a smooth, rounded curve. However, the rear wall 11 and side walls 12, 13 could also join the floor portion 15 at sharp angles (not shown). The floor portion 15 has a front edge portion 16 which is pressed into the solid material being scooped out in order to fill the scoop 10.

The floor portion 15 includes a recessed portion 17 formed in the floor portion 15 adjacent to at least one of the spaced apart side walls 12, 13 and dipping below a level of the floor portion 15 (see especially FIGS. 1, 2, and 4-6). The recessed portion 17 is preferably formed with a smooth rounded curvature on the sides which gradually tends to flatten out at the bottom of the recessed portion 17 when viewed from the front (see FIGS. 1 and 4). The recessed portion 17 is inclined or ramped downward so as to become gradually deeper in a direction toward the front edge portion 16 of the scoop 10 (see FIGS. 1 and 4-6). The gradual incline in the recessed portion 17 toward the front edge portion 16 is clearly seen from FIGS. 5 and 6. The recessed portion 17 is thus configured to guide a material contained in the scoop toward the front edge portion 16 of the scoop 10 while dispensing the material from the scoop 10. As will be discussed in more detail below, the recessed portion 17 constitutes a means, formed in the floor portion 15 adjacent to at least one of the spaced apart side walls 12 and 13, for guiding of ice pieces contained in the scoop 10 toward the front edge portion of the scoop 10 and into a container when the scoop 10 is used for ice.

With reference to FIGS. 1-4, a dividing wall 18 protrudes from the floor portion 15 at a location adjacent to the recessed portion 17 so as to divide the recessed portion 17 from a remainder of the floor portion 15. The dividing wall 18 helps to funnel or guide the solid material being dispensed from the scoop 10. Also, the dividing wall 18 helps to direct the ice to a beginning portion 19 of the recessed portion 17. The beginning portion 19 of the recessed portion 17 is approximately two-thirds of the way back from the front edge portion 16 of the scoop 10.

As best shown in FIGS. 1-4, a plurality of ribs 20 protrudes from the floor portion 15. In this case, three ribs 20A, 20B, and 20C are shown, although more or less ribs can be used. Each of the plurality of ribs 20 is shaped so as to gradually increase in height from the front edge portion 16 of the scoop 10 rearward toward the rear wall 11 with a smooth curvature like a ski jump as at 22 and then defining a blunt surface 21 facing the rear wall 11. Each of the plurality of ribs 20 is generally triangular in shape when viewed from a side view (see especially FIG. 2).

Figure 3:
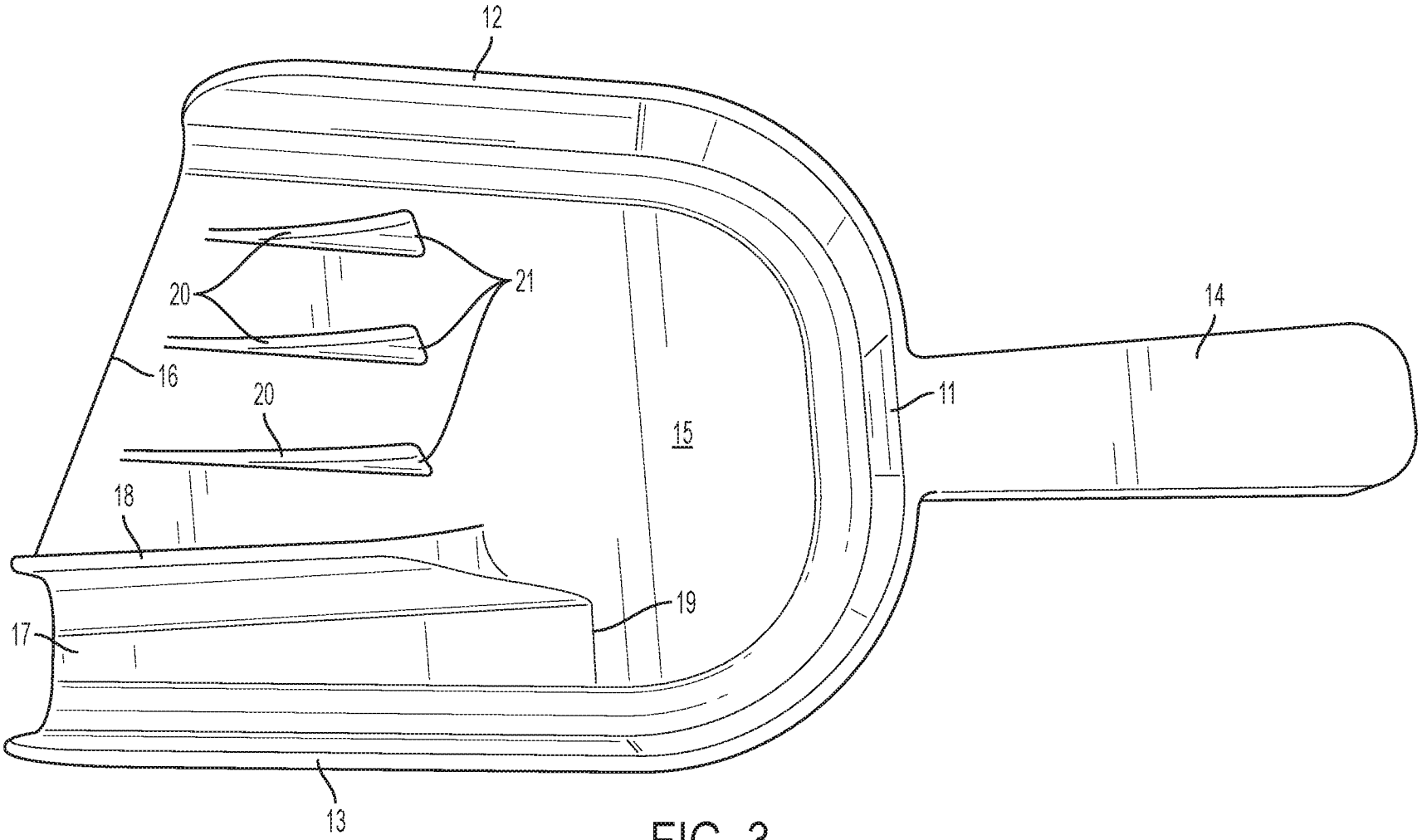
FIG. 3 illustrates a top view of the scoop according to an exemplary embodiment consistent with the present disclosure.
Figure 4:
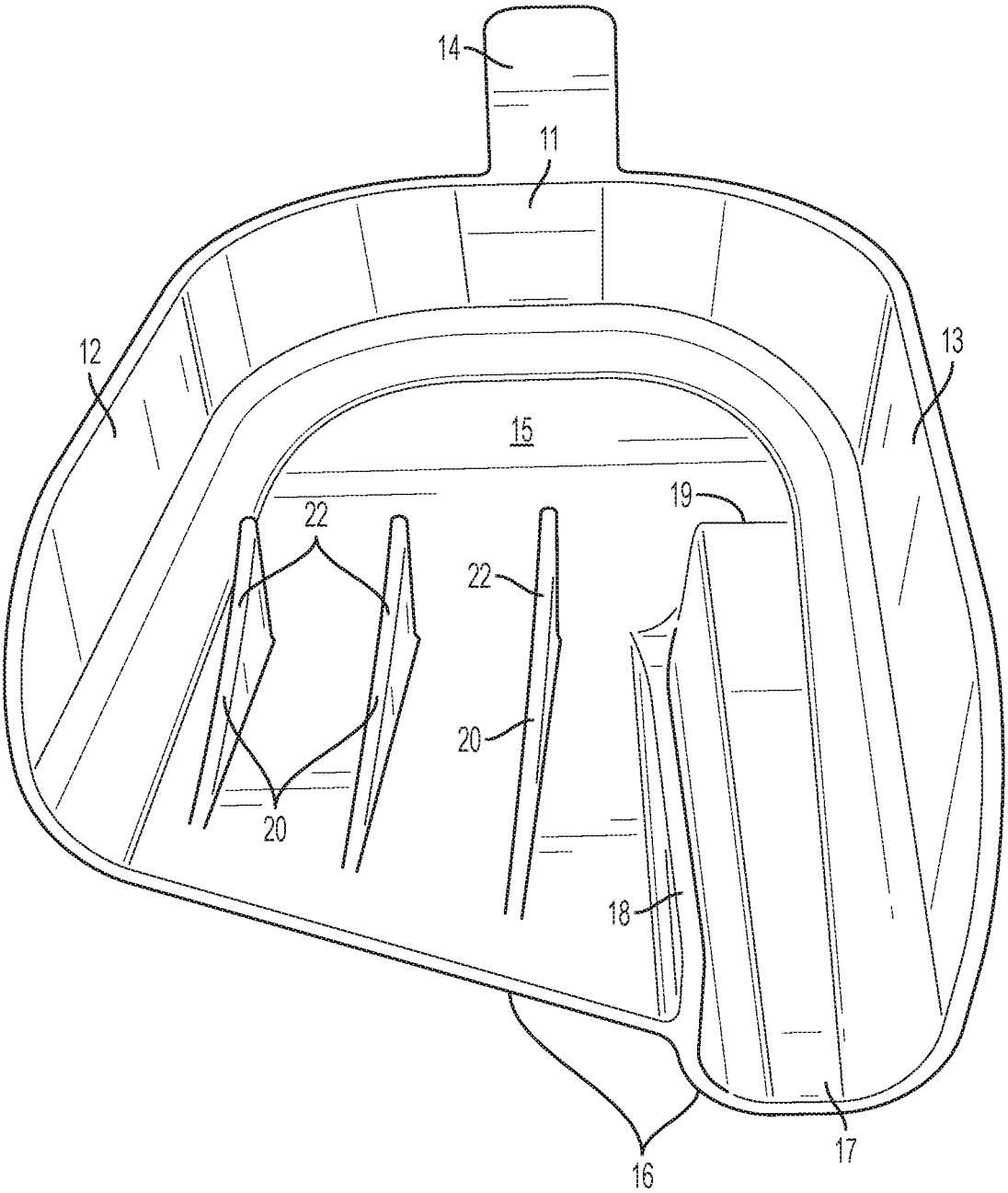
FIG. 4 illustrates a top, front perspective view of the scoop according to an exemplary embodiment consistent with the present disclosure.
Figure 5:
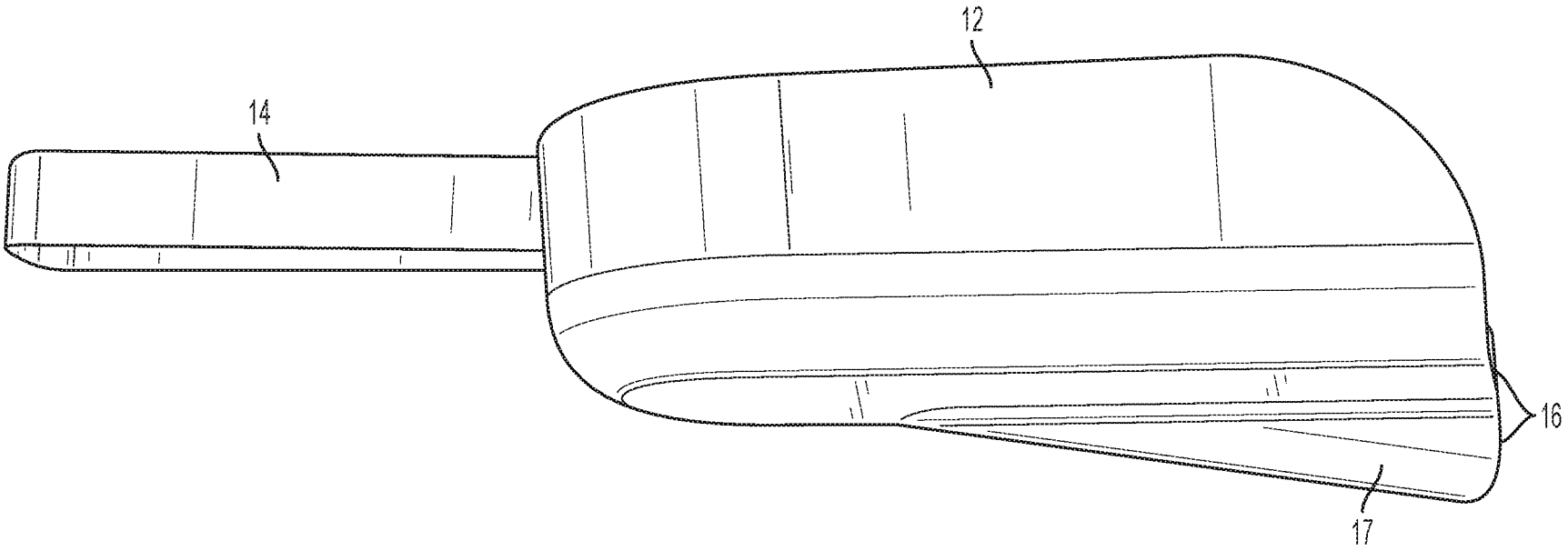
FIG. 5 illustrates a bottom, left side perspective view of the scoop according to an exemplary embodiment consistent with the present disclosure.
Figure 6:
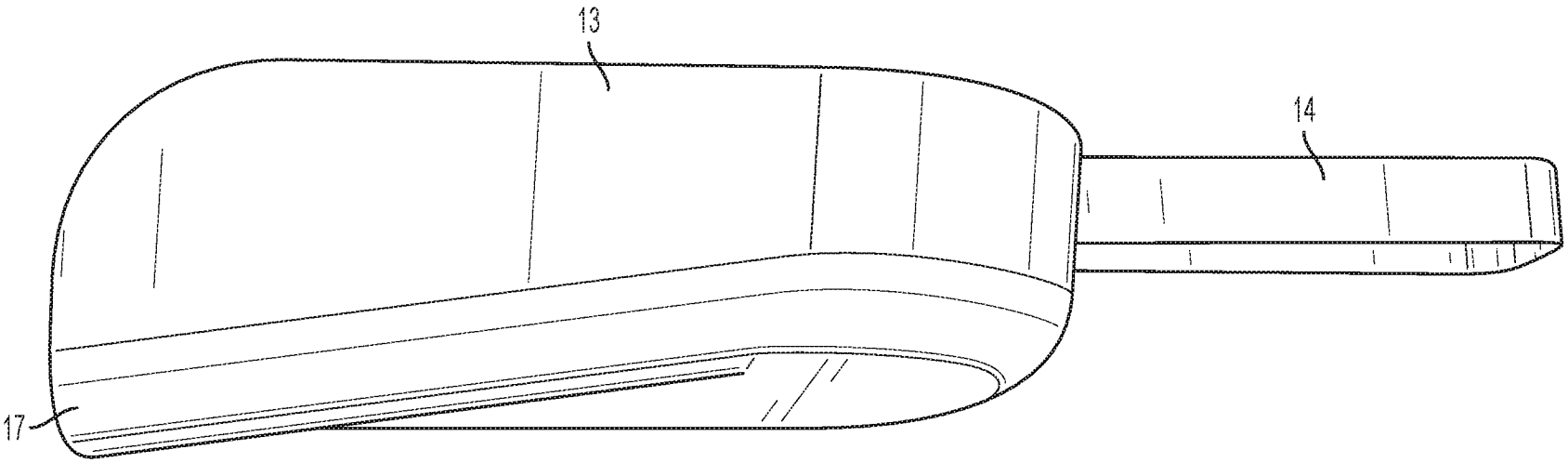
FIG. 6 illustrates a bottom, right side perspective view of the scoop according to an exemplary embodiment consistent with the present disclosure.

As best seen in FIG. 3, the front edge portion 16 of the scoop 10 is angled rearward from the dividing wall 18 to the left side wall 12, whereas the front edge portion 16 is substantially straight across at the recessed portion 17.

Figure 2:
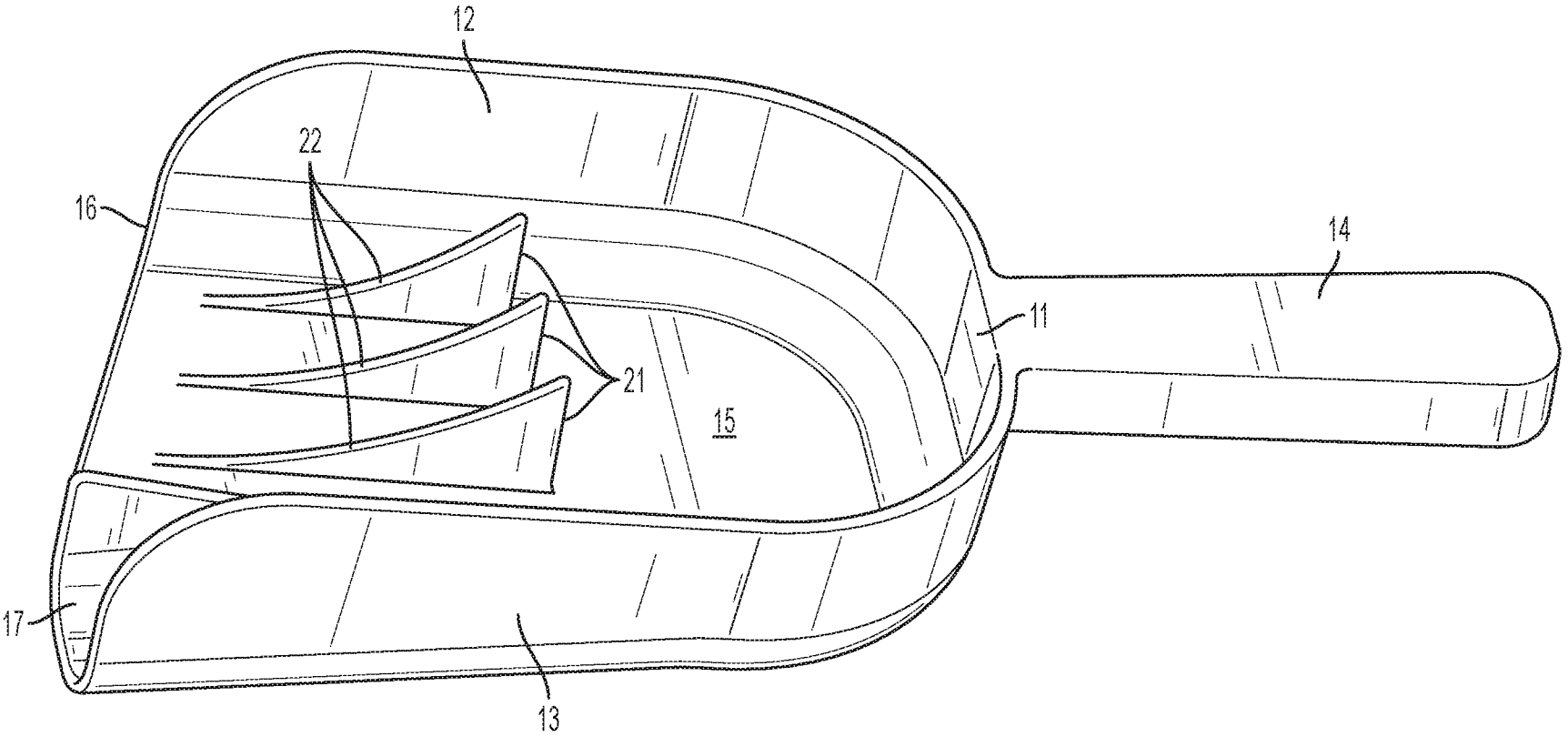
FIG. 2 illustrates a top and right side perspective view of the scoop according to an exemplary embodiment consistent with the present disclosure.
Figure 7:
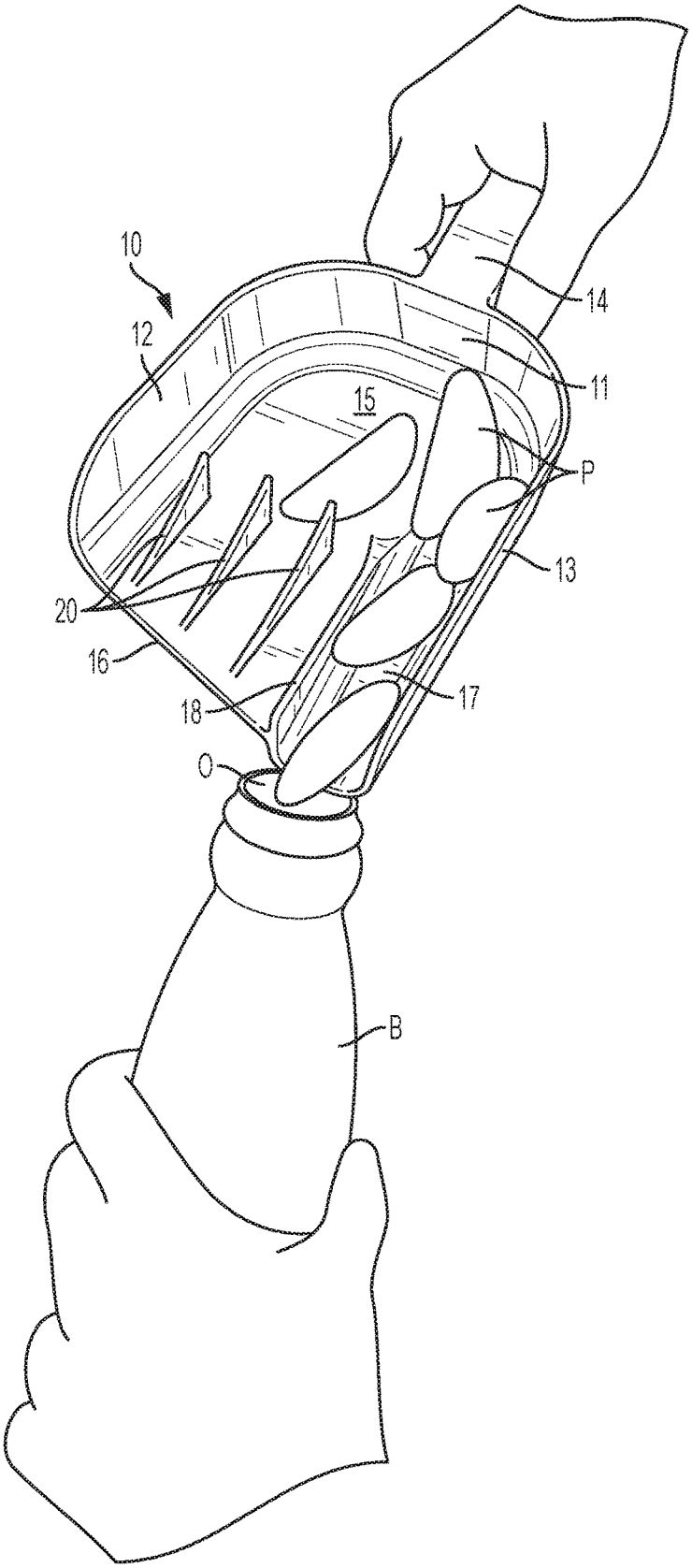
FIG. 7 illustrates a view of the scoop while in use to fill a bottle having a smaller opening with ice pieces according to an exemplary embodiment consistent with the present disclosure.

The scoop 10 is for scooping out and dispensing solid materials such as, but not limited to, sugar, coffee, grain, seeds, candy, ice, and the like. As best shown in FIGS. 1, 2, and 7, when the solid material comprises ice pieces P, the plurality of ribs 20 at first allows the ice pieces P to easily slide up the smooth curvature 22 and then keeps the ice pieces P from falling out of the scoop 10 by virtue of the blunt surfaces 21 while the ice pieces P are being dispensed from the scoop 10 through the recessed portion 17 and into, for example, a bottle B having a smaller opening O. Note that in this instance, the ice pieces P may have various shapes such as cubed, elongated, curved, rounded, etc., as is conventional in the art. FIG. 7 shows the ice pieces P with an elongated shape having one surface which is curved.

Preferably, the scoop 10 is formed of acrylonitrile butadiene styrene (ABS). The scoop 10 can be made, for example, using a three dimensional (3D) printer as a single piece of ABS. Other plastics materials can be used such as, for example, polypropylene resin. Also, the scoop 10 can be formed of stainless steel metal.

In use to scoop and dispense ice pieces P, the user grasps the handle 14 of the scoop 10 and first fills the scoop 10 with ice pieces P from an ice storage container or ice bucket (not shown). The plurality of ribs 20 at first allows the ice pieces P to easily slide up the smooth curvature 22 as the scoop 10 is filled with ice pieces and tilted rearward by the user. Then, when the user wants to begin to dispense the ice pieces P, the user starts by tilting the scoop 10 so that the ice pieces move toward the recessed portion 17 while at the same time tilting the scoop 10 forward with the end of the recessed portion 17 being aligned with the mouth of a bottle B having a smaller opening O. The recessed portion 17 acts to focus or guide the individual ice pieces P in a substantially single file fashion from the remainder of the floor portion 15 of the scoop 10 through the recessed portion 17, out the front edge portion 16, and into the smaller opening O of the bottle B. In this way, it is possible to fill a container with a smaller or narrower opening with ice pieces without spilling the ice pieces all over the counter top or the floor, as is the case when using a standard scoop. While a bottle B having a smaller opening O is shown in FIG. 7, a scoop consistent with the present invention can be used for other containers having a smaller or narrower opening such as a glass, cup, sports bottle, water bottle, etc., or in other situations where it is desired to dispense especially a solid material in a guided or focused manner from a scoop.

Figure 8:
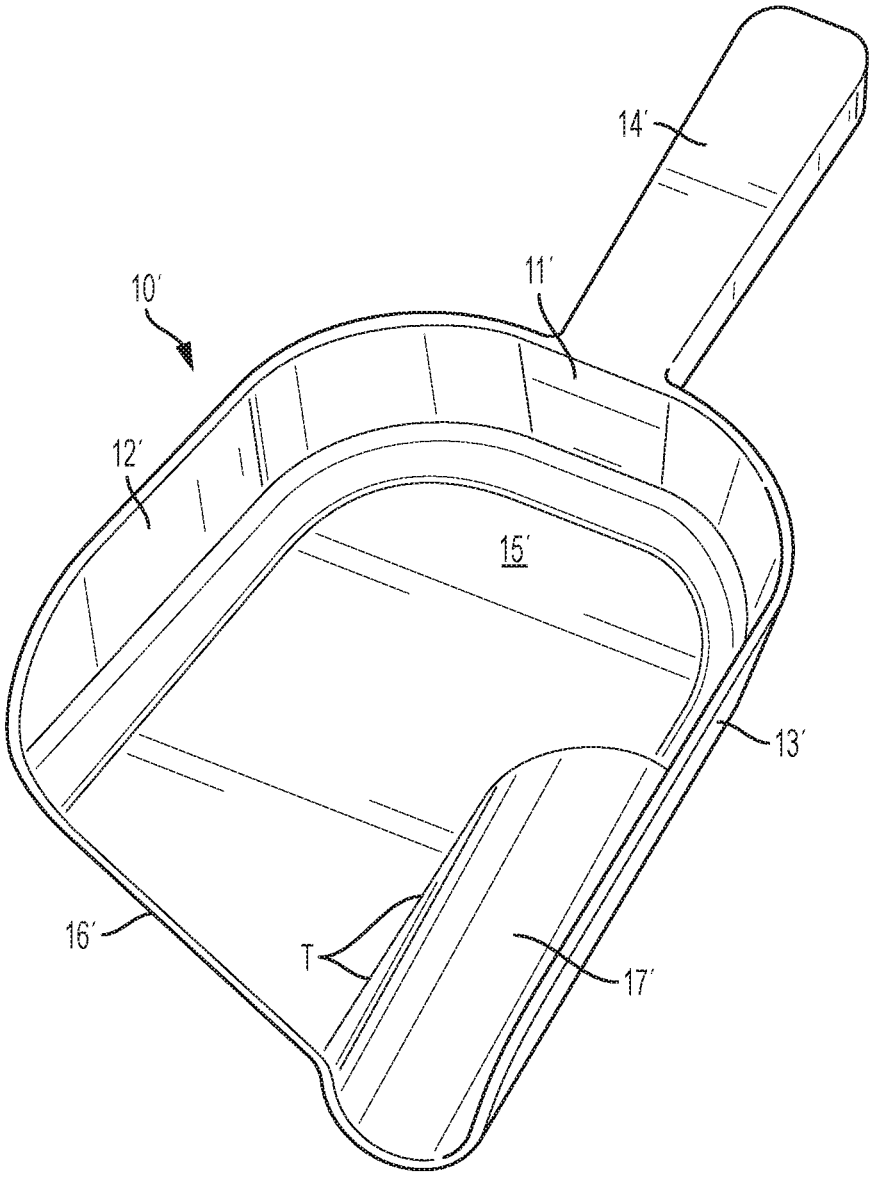
FIG. 8 illustrates another exemplary embodiment of the scoop consistent with the present disclosure.

FIG. 8 illustrates another exemplary embodiment of the scoop consistent with the present disclosure. Similar reference numbers are used to denote similar structure as in FIGS. 1-7, except that a prime sign (') is added next to the reference numeral. In particular, FIG. 8 shows an embodiment of the scoop 10' that does not include the dividing wall 18 protruding from the floor portion 15' at a location adjacent to the recessed portion 17', and also does not have any ribs 20 disposed on the floor portion 15'. Rather, the floor portion 15' is smooth and flat right up to a transition area T where the floor portion 15' joins the recessed portion 17'. In this case, the recessed portion 17' is formed with a smooth rounded curvature on its sides and at a bottom of the recessed portion 17' when viewed from a front view. The embodiment of FIG. 8 is suitable for guiding solid material that is smaller than ice pieces, such as sugar, coffee, grain, seeds, etc. Nevertheless, the recessed portion 17' also constitutes a means, formed in the floor portion 15' adjacent to at least one of the spaced apart side walls 12' and 13', for guiding of ice pieces contained in the scoop 10' toward the front edge portion of the scoop 10' and into a container when the scoop 10' is used for ice.

The present invention has substantial opportunity for variation without departing from the spirit or scope of the present invention. For example, while the recessed portion is shown formed in the floor portion adjacent to one of the spaced apart side walls, the recessed portion can be formed adjacent to the opposite side wall or on both sides to be adjacent to both side walls. Moreover, while the gripping portion is shown as a traditional handle 14 disposed on the rear wall 11, the gripping portion can be formed by an enlarged region formed along an upper edge of the rear wall 11 or either one or both of the side walls 12, 13 of the scoop 10 and which can be gripped by the user's fingers. For example, if the scoop 10 is formed of a plastic material, the enlarged region can be an extension of plastic large enough to grip with the fingers and thumb.

Those skilled in the art will recognize improvements and modifications to the exemplary embodiments of the present invention. All such improvements and modifications are considered within the scope of the concepts disclosed herein and the claims that follow.

What is claimed is:

1. An ice scoop comprising:

a rear wall and a pair of spaced apart side walls;

a gripping portion disposed on at least one of the rear wall or side walls;

a floor portion connected to the rear wall and the pair of spaced apart side walls, the floor portion having a front edge portion;

a recessed portion formed in the floor portion alongside at least one of the spaced apart side walls and dipping below a level of the floor portion, such that the at least one of the spaced apart side walls is contiguous with the recessed portion and forms at least a portion of an outer side wall of the recessed portion, the recessed portion being inclined downward so as to become gradually deeper in a direction toward the front edge portion of the ice scoop, the recessed portion being configured to guide ice pieces contained in the ice scoop toward the front edge portion of the ice scoop while dispensing the ice pieces from the ice scoop; and a plurality of ribs protruding from the floor portion, wherein each of the plurality of ribs is shaped so as to gradually increase in height from the front edge portion of the ice scoop rearward toward the rear wall and then define a blunt surface spaced apart from and facing the rear wall, the blunt surface of each of the plurality of ribs and the rear wall defining a holding region therebetween, and wherein the plurality of ribs keeps the ice pieces in the holding region and from falling out of the ice scoop while the ice pieces are being dispensed from the ice scoop through the recessed portion.

2. The ice scoop of claim 1, further comprising a dividing wall protruding from the floor portion at a location adjacent to the recessed portion so as to divide the recessed portion from a remainder of the floor portion.

3. The ice scoop of claim 1, wherein each of the plurality of ribs is generally triangular in shape when viewed from a side view.

4. The ice scoop of claim 1, wherein the rear wall and the pair of spaced apart side walls join the floor portion with a smooth curve.

5. The ice scoop of claim 1, wherein the recessed portion is formed with a smooth rounded curvature on its sides which gradually flatten out at a bottom of the recessed portion when viewed from a front view.

6. The ice scoop of claim 1, wherein the recessed portion is formed with a smooth rounded curvature on its sides and at a bottom of the recessed portion when viewed from a front view.

7. The ice scoop of claim 1, wherein the gripping portion comprises a handle disposed on the rear wall.

8. The ice scoop of claim 1, wherein the ice scoop is formed of at least one of acrylonitrile butadiene styrene (ABS), polypropylene resin, or stainless steel metal.

9. An ice scoop comprising:

a rear wall and a pair of spaced apart side walls;

a gripping portion disposed on at least one of the rear wall or side walls;

a floor portion connected to the rear wall and the pair of spaced apart side walls, the floor portion having a front edge portion;

means, formed in the floor portion alongside and contiguous with at least one of the spaced apart side walls, for guiding of ice pieces contained in the ice scoop in a substantially single file fashion from a remainder of the floor portion of the ice scoop toward the front edge portion of the ice scoop and into a container, and a plurality of ribs protruding from the floor portion, wherein each of the plurality of ribs is shaped so as to gradually increase in height from the front edge portion of the ice scoop rearward toward the rear wall and then define a blunt surface spaced apart from and facing the rear wall, the blunt surface of each of the plurality of ribs and the rear wall defining a holding region therebetween, and wherein the plurality of ribs keeps the ice pieces in the holding region and from falling out of the ice scoop while the ice pieces are being dispensed from the ice scoop through the means for guiding.

10. The ice scoop of claim 9, wherein each of the plurality of ribs is generally triangular in shape when viewed from a side view.

11. The ice scoop of claim 9, wherein the rear wall and the pair of spaced apart side walls join the floor portion with a smooth curve.

12. The ice scoop of claim 9, wherein the gripping portion comprises a handle disposed on the rear wall.

13. The ice scoop of claim 9, wherein the means for guiding comprises a recessed portion that is inclined downward so as to become gradually deeper in a direction toward the front edge portion of the ice scoop.

14. The ice scoop of claim 9, wherein the ice scoop is formed of at least one of acrylonitrile butadiene styrene (ABS), polypropylene resin, or stainless steel metal.

15. The ice scoop of claim 1, wherein a beginning portion of the recessed portion is approximately two-thirds of the way back from the front edge portion of the ice scoop as compared to a distance between the front edge portion of the ice scoop and the rear wall of the ice scoop.

* * * * *